US012752211B2

(12) United States Patent
Fei et al.

(10) Patent No.: US 12,752,211 B2
(45) Date of Patent: Oct. 6, 2026

(54) MAGNETIC CRANE AND MAGNETIC TILE TOY INCLUDING SUCH MAGNETIC CRANE

(71) Applicant: Zhejiang Jiajiao Holdings Group Co., Ltd., Jiaxing (CN)

(72) Inventors: Yiye Fei, Jiaxing (CN); Jiezhi Huang, Jiaxing (CN)

(73) Assignee: Zhejiang Jiajiao Holdings Group Co., Ltd., Jiaxing (CN)

( * ) Notice: Subject to any disclaimer, the term of this patent is extended or adjusted under 35 U.S.C. 154(b) by 194 days.

(21) Appl. No.: 18/814,207

(22) Filed: Aug. 23, 2024

(65) Prior Publication Data

US 2025/0205614 A1 Jun. 26, 2025

(30) Foreign Application Priority Data

Dec. 20, 2023 (CN) ..... 202323498328.4

(51) Int. Cl.
*A63H 17/12* (2006.01)
*A63H 33/04* (2006.01)
*A63H 33/26* (2006.01)

(52) U.S. Cl.
CPC ..... *A63H 33/26* (2013.01); *A63H 17/12* (2013.01); *A63H 33/046* (2013.01)

(58) Field of Classification Search
CPC .... A63H 17/12; A63H 33/00; A63H 33/0044; A63H 33/0046; A63H 33/26
USPC ..... D21/528
See application file for complete search history.

(56) References Cited

U.S. PATENT DOCUMENTS 1,685,707 A * 9/1928 Keedy ..... A63H 17/12 212/292
1,745,276 A * 1/1930 Sherwood ..... A63H 17/12 212/331
2,020,803 A * 11/1935 Sauer ..... A63H 17/12 212/253
2,567,083 A * 9/1951 Stickle ..... A63H 17/12 212/323
2,623,774 A * 12/1952 Hubbard ..... A63H 17/12 414/737
2,940,607 A * 6/1960 Bonanno ..... A63H 17/12 192/84.92

(Continued)

FOREIGN PATENT DOCUMENTS

CN 111803972 A 10/2020
CN 217119334 U 8/2022
CN 218106739 U 12/2022

*Primary Examiner* — Kurt Fernstrom
(74) *Attorney, Agent, or Firm* — JEEN IP LAW, LLC

(57) ABSTRACT

The present invention discloses a magnetic crane and a magnetic tile toy including such magnetic crane, and relates to the field of toy technologies. The magnetic crane includes a base and a first magnet block mounted in a frame thereof. The first magnet block can be attracted to another magnetic tile, thereby fixing the crane at a certain position. Additionally, a second magnet block is mounted in the magnetic suction assembly. The second magnet block can be attracted to another magnetic tile, so as to lift the magnetic tile. As a hollow limiting assembly is turned over and an elevating frame is pulled, the magnetic tile can be moved and elevated. A turnplate fixed on the base allows the hollow limiting assembly to rotate at any angle, providing more play options of the magnetic tile and enhancing children's play enjoyment.

8 Claims, 5 Drawing Sheets

(56) References Cited

U.S. PATENT DOCUMENTS

| | | | | | |
|---|---|---|---|---|---|
| 3,104,015 | A | * | 9/1963 | Goldfarb | A63H 17/12<br>446/426 |
| 3,926,316 | A | * | 12/1975 | Luttrell | B66C 23/48<br>414/710 |
| 3,997,061 | A | * | 12/1976 | Sano | A63H 17/12<br>212/174 |
| 5,413,515 | A | * | 5/1995 | Knox | A63H 17/12<br>446/85 |

* cited by examiner

MAGNETIC CRANE AND MAGNETIC TILE TOY INCLUDING SUCH MAGNETIC CRANE

CROSS-REFERENCE TO RELATED APPLICATIONS

The application claims priority to Chinese patent application No. 202323498328.4, filed on Dec. 20, 2023, the entire contents of which are incorporated herein by reference.

TECHNICAL FIELD

The present invention relates to the field of toy technologies, specifically to a magnetic crane and a magnetic tile toy including such magnetic crane.

BACKGROUND

A magnetic toy refers to a toy with magnets or magnetic components. Popular magnetic toy products on the market have magnetic tile toys, magnetic clay (magnetic mud), and the like, which can be shaped into any form through combination and attraction. The magnetic tiles, also called "magnetic building blocks", are a type of toy for early childhood education from the United States. The magnetic tiles are mainly used for building magnetic geometric shapes with a variety of colors in two dimensions or three dimensions.

The magnetic tiles are spliced together through magnetic attraction to form various shapes, which helps develop children's imagination. The cross-sectional shapes of the magnetic tiles are typically triangles, quadrangles, and the like. The magnetic tiles in these shapes are spliced together to create various structures. However, this method of splicing magnetic tiles provides limited play options with a relatively simple structure, which easily causes children to lose interest. Therefore, there is a need for a magnetic toy that can be used with magnetic tiles to enhance children's play enjoyment.

SUMMARY

An objective of the present invention is to provide a magnetic crane and a magnetic tile toy including such magnetic crane to resolve the above problem in the background.

To resolve the above technical problem, the technical solution used in the present invention is as follows:

A magnetic crane is provided, including a base, a hollow limiting assembly, a lifting assembly, a swing arm, and a magnetic suction assembly. A first magnet block is mounted on an inner side of the base, the base is rotatably connected with a turnplate at a center, a U-shaped support frame is fixed on the turnplate at a center, the hollow limiting assembly is rotatably connected via a first positioning pin in a U-shaped groove of the U-shaped support frame, the lifting assembly is inserted into a cavity in the middle of the hollow limiting assembly, the swing arm is rotatably connected to a top portion of the lifting assembly via a positioning pin, a bottom portion of the swing arm is rotatably connected to the magnetic suction assembly via a second positioning pin, and a second magnet block is mounted below in the magnetic suction assembly. The hollow limiting assembly rotates around the first positioning pin as a fulcrum. The lifting assembly can move within the cavity inside the hollow limiting assembly, so as to extend or retract. The turnplate can rotate 360° on the base. The swing arm and the limiting rib plate of the lifting assembly are connected via a positioning pin, allowing rotation around the positioning pin as a fulcrum. As the first magnet block is mounted on an inner side of the base, the base can be attracted to another magnetic tile.

Preferably, the hollow limiting assembly includes a left hollow shell and a right hollow shell, the left hollow shell and the right hollow shell are joined and screwed to each other, and bottom portions of the left hollow shell and the right hollow shell are disposed in the U-shaped groove of the U-shaped support frame. Positioning pins are fixed above and below the left hollow shell, and the right hollow shell and the positioning pin are joined and screwed to each other.

Preferably, the bottom portions of the left hollow shell and the right hollow shell are uniformly fixed with first limiting teeth, and a bottom of the U-shaped groove of the U-shaped support frame is uniformly fixed with second limiting teeth.

Preferably, the first limiting teeth mesh with the second limiting teeth. The first limiting teeth do not fully mesh with the second limiting teeth under the action of the first positioning pin, leaving some gaps between the meshing points. Both the first limiting teeth and the second limiting teeth are made of plastic, so the hollow limiting assembly can be turned over with a certain amount of force relative to U-shaped support frame.

Preferably, the lifting assembly includes an elevating frame and a limiting rib plate, a top portion of the elevating frame is fixedly connected to a bottom portion of the limiting rib plate, two sides of a bottom portion of the elevating frame are each provided with a plastic snap fastener, and the plastic snap fastener abuts in a limiting hole provided in the hollow limiting assembly. The interior of the elevating frame is hollowed out. A flange is fixed around the circumference of the limiting hole. When the plastic snap fastener contacts the flange, it retracts into the elevating frame. When it leaves the flange, it returns to its original position and snaps into the limiting hole.

Preferably, limiting plates are fixed on two sides of the bottom portion of the elevating frame adjacent to the plastic snap fasteners, and the limiting plates limit the elevating frame to avoid detachment from the hollow limiting assembly. The width of the top opening of the hollow limiting assembly is greater than the width of the elevating frame, so the limiting plate can limit the elevating frame to avoid detachment from the hollow limiting assembly.

Preferably, the magnetic suction assembly includes a right shell and a left shell, cavities for placing the second magnet block are provided in the right shell and the left shell at the bottom, one end of the second positioning pin is fixed in the middle of the right shell, and the other end of the second positioning pin penetrates the swing arm and is screwed to the left shell. After the right shell and the left shell are joined via the second positioning pin, they are aligned and fixed with screws, and then welded using ultrasonic. The second magnet block can be used to attract magnetic tiles of other structures.

Preferably, the present invention further provides a magnetic tile toy including such magnetic crane described above.

Due to the adoption of the above technical solution, the present invention achieves the following technical advancements over the prior art: The present invention provides a magnetic crane and a magnetic tile toy including such magnetic crane. A is mounted in a frame of the base. The can be attracted and connected to a magnet in a magnetic tile of another structure, thereby fixing the crane at a certain position. Additionally, a second magnet block is mounted in the magnetic suction assembly. The second magnet block can be magnetically attracted and connected to a magnet of another magnetic tile, so as to lift the magnetic tile. As the hollow limiting assembly is turned over and an elevating frame is pulled, the magnetic tile can be moved and elevated. The turnplate fixed on the base allows the hollow limiting assembly to rotate at any angle, providing more play options of the magnetic tiles and enhancing children's play enjoyment.

In the figure: 1, base; 101, first magnet block; 2, U-shaped support frame; 201, turnplate; 202, second limiting teeth; 3, hollow limiting assembly; 301, left hollow shell; 302, right hollow shell; 303, first limiting teeth; 304, first positioning pin; 305, limiting hole; 4, elevating frame; 401, limiting plate; 5, limiting rib plate; 6, swing arm; 7, right shell; 701, second positioning pin; 8, left shell; 9, second magnet block; and 10, magnetic tile.

DETAILED DESCRIPTION OF THE EMBODIMENTS

The present invention is further described below in detail with reference to the embodiments.

Figure 1:
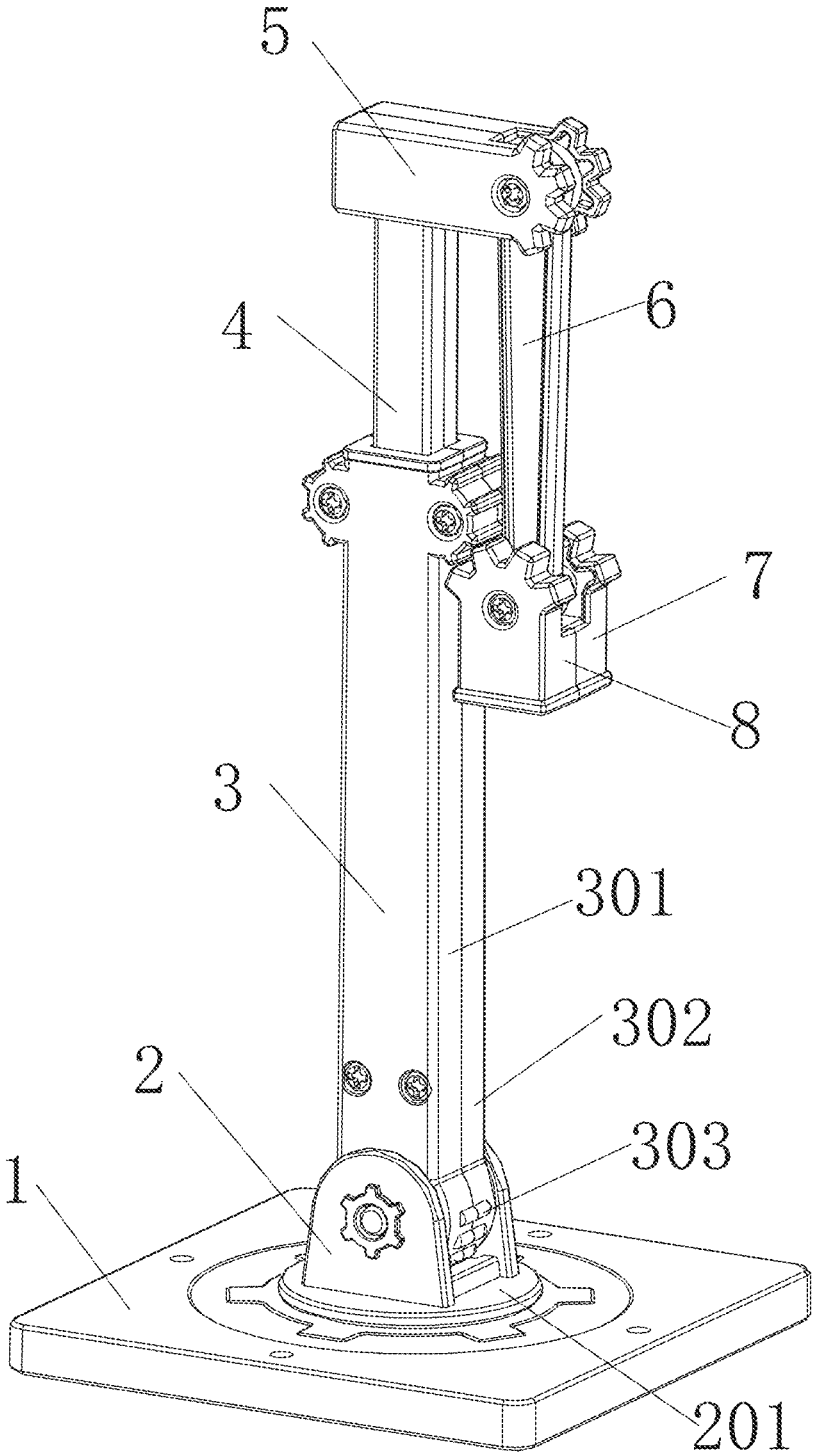
FIG. 1 is a schematic diagram of an overall structure according to the present invention.

As shown in FIG. 1, the present invention provides a magnetic crane, including a base 1, a hollow limiting assembly 3, a lifting assembly, a swing arm 6, and a magnetic suction assembly. A first magnet block 101 is mounted on an inner side of the base 1, and the base 1 is rotatably connected via a turnplate 201 at a center. The turnplate 201 is clamped to the base 1 via protrusions on its bottom circumference. A U-shaped support frame 2 is fixed above the turnplate 201 at a center, and the turnplate 201 allows the U-shaped support frame 2 to achieve 360° rotation. The U-shaped support frame 2 is rotatably connected to the hollow limiting assembly 3 via a first positioning pin 304. The first positioning pin 304 is mounted on the U-shaped support frame 2. The lifting assembly is inserted into a cavity in the middle of the hollow limiting assembly 3. Atop portion of the lifting assembly is rotatably connected to the swing arm 6 via a positioning pin, and a bottom portion of the swing arm 6 is rotatably connected to the magnetic suction assembly via a second positioning pin 701. A second magnet block 9 is mounted below in the magnetic suction assembly.

Figure 2:
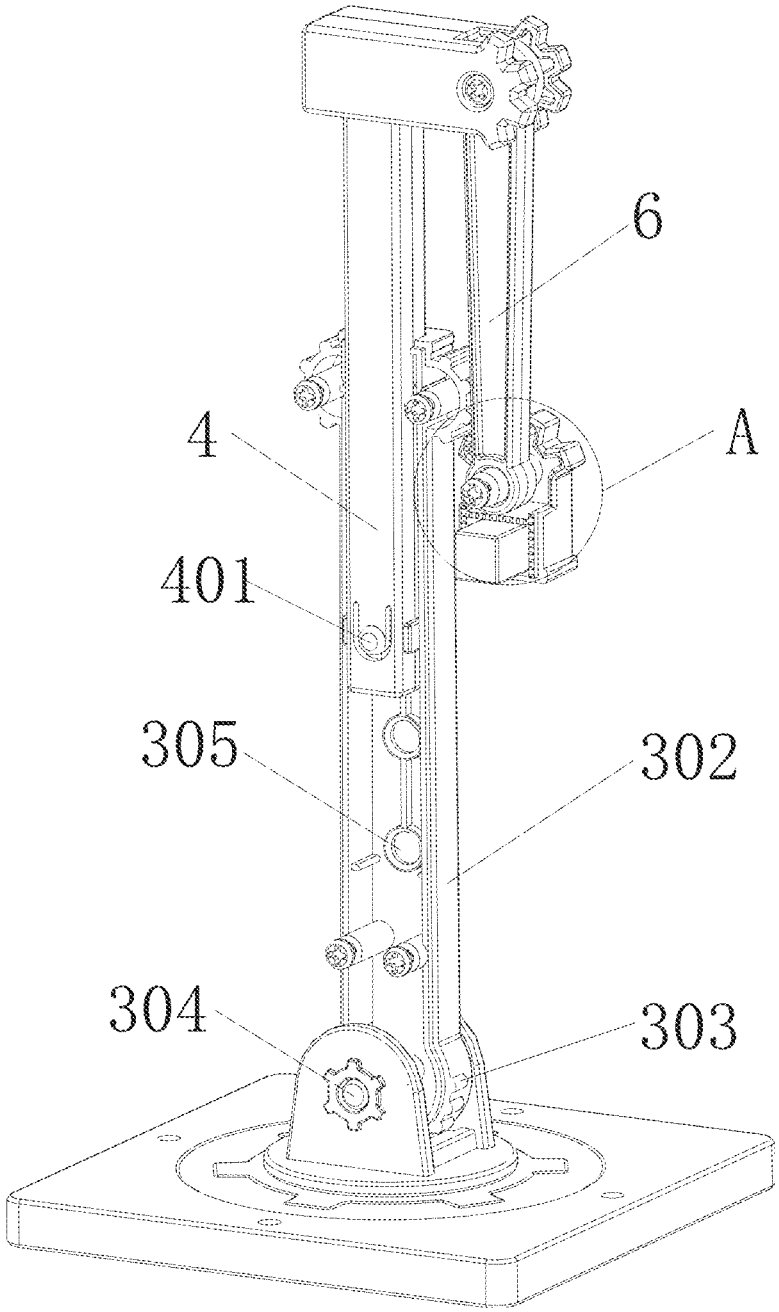
FIG. 2 is a schematic diagram of a partially disassembled structure of the overall structure according to the present invention.
Figure 3:
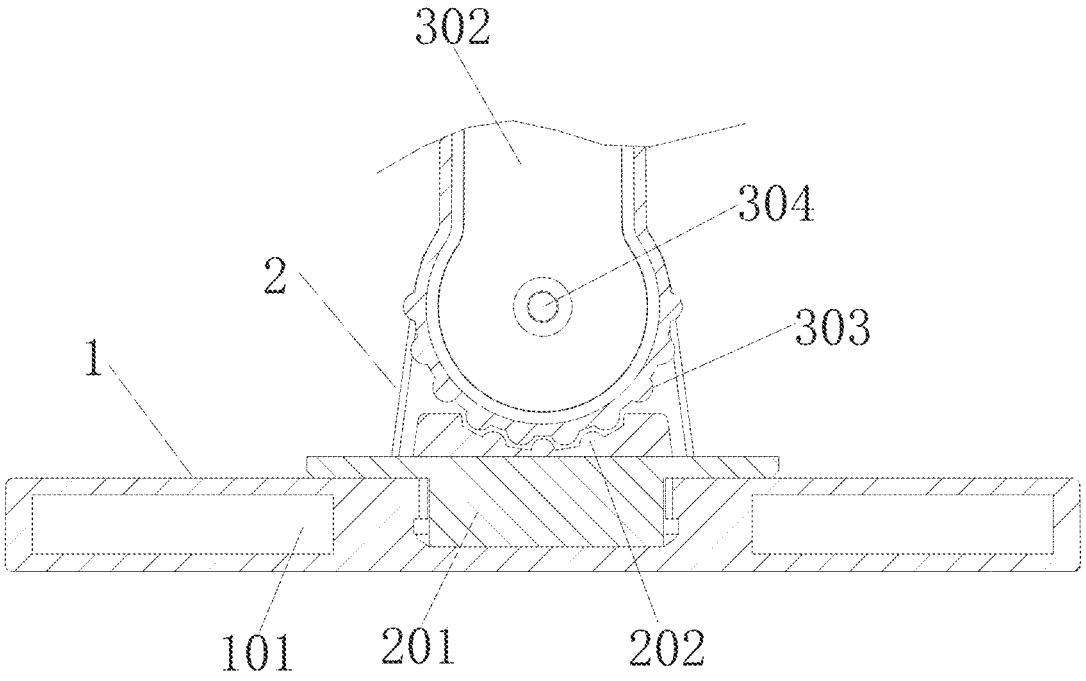
FIG. 3 is a schematic structural cross-sectional view of a base according to the present invention.
Figure 4:
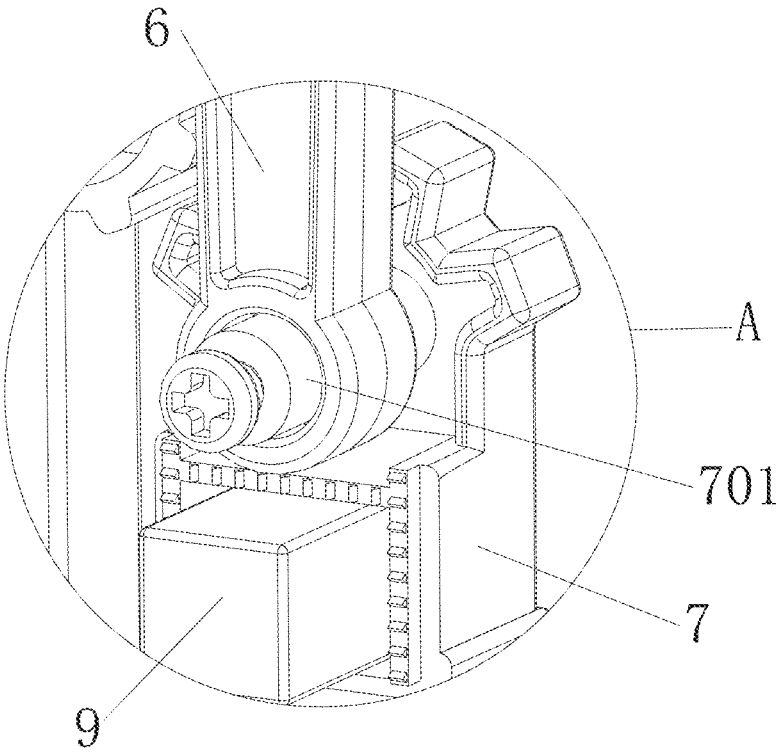
FIG. 4 is a schematic diagram of an enlarged structure at A in FIG. 2 according to the present invention.

As shown in FIGS. 2 and 3, the hollow limiting assembly 3 includes a left hollow shell 301 and a right hollow shell 302. After the left hollow shell 301 is inserted into the positioning pin of the right hollow shell 302, it is fixed by tightening screws. The bottom portions of the left hollow shell 301 and the right hollow shell 302 are uniformly fixed with first limiting teeth 303. The bottom of the U-shaped groove of the U-shaped support frame 2 is uniformly fixed with second limiting teeth 202. The first limiting teeth 303 and the second limiting teeth 202 mesh with each other. Under the constraint of the first positioning pin 304, the first limiting teeth 303 are kept at a certain distance from and do not fully mesh with the second limiting teeth 202. Additionally, since both the second limiting teeth 202 and the first limiting teeth 303 are made of plastic, the hollow limiting assembly 3 can be rotated with a certain amount of torque, causing the second limiting teeth 202 and the first limiting teeth 303 to engage or disengage, thereby allowing the hollow limiting assembly 3 to rotate while ensuring stability and preventing automatic rotation when an object is lifted.

Further, a first magnet block 101 is mounted on an inner side of the base 1. The first magnet block 101 allows the crane toy to be attracted to a magnetic tile 10 of another structure, thus providing diverse play options.

As shown in FIG. 2, the lifting assembly includes an elevating frame 4 and a limiting rib plate 5. The top portion of the elevating frame 4 is fixedly connected to the bottom portion of the limiting rib plate 5. The elevating frame 4 is slidingly arranged in the cavity in the middle of the hollow limiting assembly 3. The limiting rib plate 5 is rotatably connected to the swing arm 6 via a positioning pin.

Further, the middle of the elevating frame 4 is hollow, and two opposite surfaces near the bottom of the elevating frame 4 are provided with plastic snap fasteners 401. The plastic snap fastener 401 has a cylindrical head that, when subjected to extrusion force, enters the cavity in the middle of the elevating frame 4. The left hollow shell 301 and the right hollow shell 302 are both provided with limiting holes 305 that match the cylindrical heads. There are multiple limiting holes 305, and a flange is fixed around the circumference of each limiting hole 305. When a child pulls the elevating frame 4 outward, the cylindrical head is extruded by the flange to enter the cavity in the middle of the elevating frame 4. Once released, the cylindrical head pops out (due to the elasticity of the plastic structure) and enters the limiting hole 305, achieving engagement. To make a switch to another limiting hole 305, greater force is needed to pull the elevating frame 4 outward.

Further, limiting plates are fixed on both sides of the bottom of the elevating frame 4 adjacent to the plastic snap fasteners 401. The width of the top opening of the hollow limiting assembly 3 is greater than the width of the elevating frame 4. When the limiting plates approach the top opening of the hollow limiting assembly 3, they limit the movement of the elevating frame 4, preventing it from being pulled out of the cavity of the hollow limiting assembly 3.

As shown in FIGS. 1 and 2, one end of the limiting rib plate 5 has a U-shaped opening, within which the swing arm 6 is rotatably arranged via a positioning pin. The bottom of the swing arm 6 away from the limiting rib plate 5 has a round hole. The magnetic suction assembly includes a right shell 7 and a left shell 8. A second positioning pin 701 is fixed at the center of the inner wall of the right shell 7 and penetrates the round hole to connect with the left shell 8. The second positioning pin 701 has a screw hole. After the right shell 7 and the left shell 8 are joined, screws are driven into the second positioning pin 701 for fixing. Once connected via the second positioning pin 701 and the round hole, the right shell 7 and the left shell 8 can rotate on the swing arm 6. After the right shell 7 and the left shell 8 are joined, they are fixed by ultrasonic welding.

Further, cavities for placing the second magnet block 9 are provided in the right shell 7 and the left shell 8 at the bottom. Before the right shell 7 and the left shell 8 are joined, the second magnet block 9 is placed into the cavity. The second magnet block 9 can be used to attract other magnetic tiles 10 of any shape.

Figure 5:
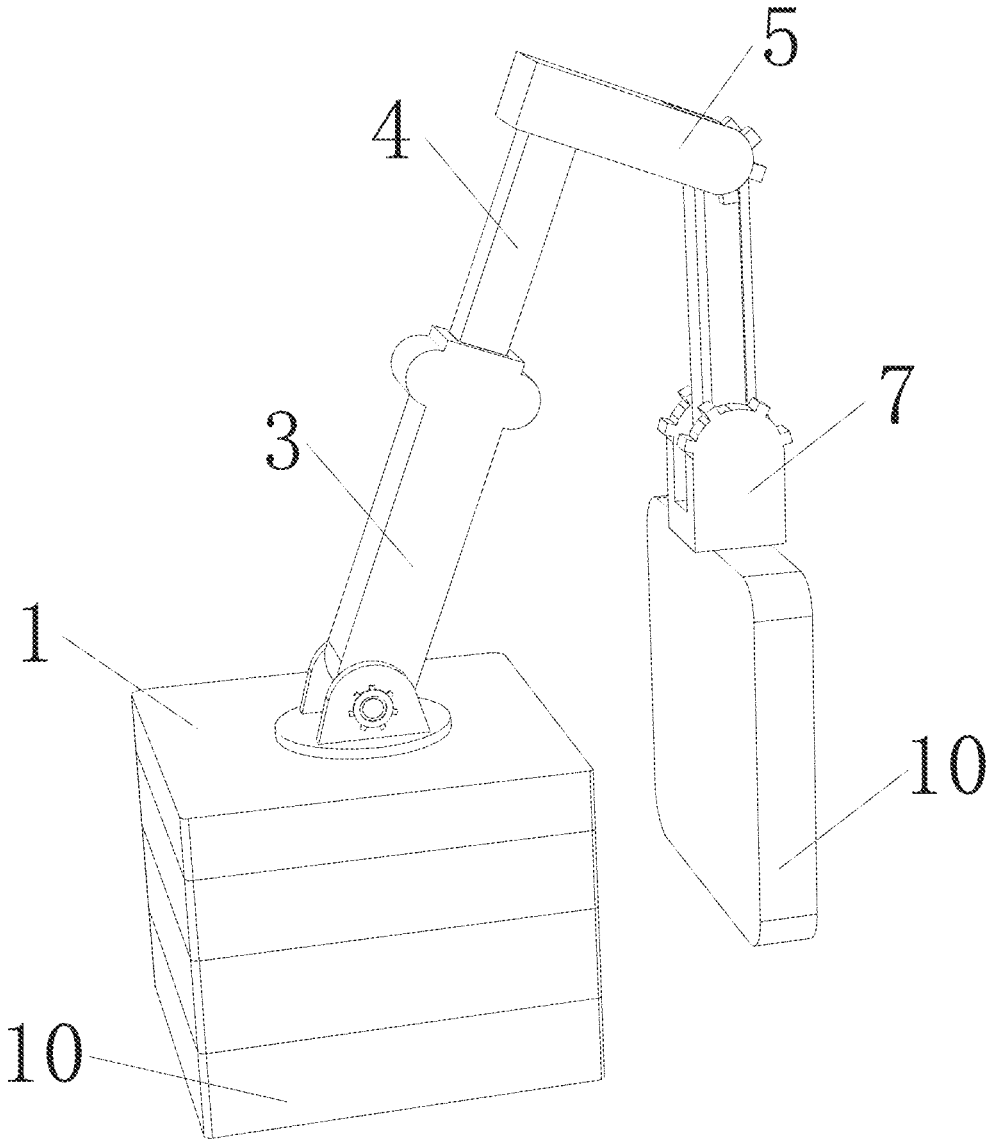
FIG. 5 is a schematic structural diagram of magnetic tiles according to the present invention.

As shown in FIG. 5, a magnetic tile toy including such magnetic crane is provided. The first magnet block 101 in the base 1 of the magnetic crane included by the magnetic tile toy can attract other multiple magnetic tiles 10, to fix the entire the crane toy. Children can manually rotate the swing arm 6, causing the second magnet block 9 in the right shell 7 and the left shell 8 to attract other magnetic tiles 10 of any shape, and pull the elevating frame 4 longer, to lift the magnetic tiles 10. The base 1 and a regular square magnetic tile 10 are in the same size.

The following specifically describes the operation principles of the magnetic crane and the magnetic tile toy including such magnetic crane.

As shown in FIGS. 1 to 5, first, the base 1 is attracted and connected to multiple magnetic tiles 10 via the first magnet block 101. Then, the second magnet block 9 in the magnetic suction assembly attracts magnetic tiles 10 of any shape. Based on children's play needs, the hollow limiting assembly 3 is arbitrarily rotated until a suitable play angle is adjusted, and the elevating frame 4 can be extended from or retracted into by a length the hollow limiting assembly 3, causing the limiting rib plate 5 to drive the swing arm 6 and the magnetic suction assembly to ascend or descend. The hollow limiting assembly 3 can achieve 360° rotation via the turnplate 201, thereby enabling the transportation of the magnetic tiles 10. This provides more play options of the magnetic tiles 10 and enhances children's play enjoyment.

It should be noted that in the descriptions of the present disclosure, unless otherwise specified and defined explicitly, the terms "dispose", "mount", "interconnect", and "connect" should be understood in their general senses. For example, they may refer to a fixed connection, a detachable connection, or an integral connection, may refer to a mechanical connection, or may refer to a direct connection, an indirect connection via an intermediate medium, an interaction between two elements, or a mutual action relationship between two elements. Persons of ordinary skill in the art can understand specific meanings of these terms in the present disclosure based on specific situations.

The above is a detailed general description of the present invention, and some modifications or improvements can be made based on the present invention. This is apparent to those skilled in the art. Therefore, modifications or improvements that do not depart from the spirit of the present invention are within the scope of the protection of the present invention.

What is claimed is:

1. A magnetic crane, comprising a base, a hollow limiting assembly, a lifting assembly, a swing arm, and a magnetic suction assembly, wherein a first magnet block is mounted on an inner side of the base, the base is rotatably connected with a turnplate at a center, a U-shaped support frame is fixed above the turnplate at a center, the hollow limiting assembly is rotatably connected via a first positioning pin in a U-shaped groove of the U-shaped support frame, the lifting assembly is inserted into a cavity in the middle of the hollow limiting assembly, the swing arm is rotatably connected to a top portion of the lifting assembly via a positioning pin, a bottom portion of the swing arm is rotatably connected to the magnetic suction assembly via a second positioning pin, and a second magnet block is mounted below in the magnetic suction assembly.

2. The magnetic crane according to claim 1, wherein the hollow limiting assembly comprises a left hollow shell and a right hollow shell, the left hollow shell and the right hollow shell are joined and screwed to each other, and bottom portions of the left hollow shell and the right hollow shell are disposed in the U-shaped groove of the U-shaped support frame.

3. The magnetic crane according to claim 2, wherein the bottom portions of the left hollow shell and the right hollow shell are uniformly fixed with first limiting teeth, and a bottom of the U-shaped groove of the U-shaped support frame is uniformly fixed with second limiting teeth.

4. The magnetic crane according to claim 3, wherein the first limiting teeth mesh with the second limiting teeth.

5. The magnetic crane according to claim 1, wherein the lifting assembly comprises an elevating frame and a limiting rib plate, a top portion of the elevating frame is fixedly connected to a bottom portion of the limiting rib plate, two sides of a bottom portion of the elevating frame are each provided with a plastic snap fastener, and the plastic snap fastener abuts in a limiting hole provided in the hollow limiting assembly.

6. The magnetic crane according to claim 5, wherein limiting plates are fixed on two sides of the bottom portion of the elevating frame adjacent to the plastic snap fasteners, and the limiting plates limit the elevating frame to avoid detachment from the hollow limiting assembly.

7. The magnetic crane according to claim 1, wherein the magnetic suction assembly comprises a right shell and a left shell, cavities for placing the second magnet block are provided in the right shell and the left shell at the bottom, one end of the second positioning pin is fixed in the middle of the right shell, and the other end of the second positioning pin penetrates the swing arm and is screwed to the left shell.

8. A magnetic tile toy, comprising at least one magnetic crane according to claim 1.

* * * * *